United States Patent [19]

Rogers et al.

[11] Patent Number: 4,638,604

[45] Date of Patent: Jan. 27, 1987

[54] STAGING STRUCTURE

[75] Inventors: O. David Rogers, Farwell; John Bardwick, III, Tipton; Kenneth Staten, Clare, all of Mich.

[73] Assignee: Stage Rite Corporation, Farwell, Mich.

[21] Appl. No.: 607,978

[22] Filed: May 7, 1984

[51] Int. Cl.[4] ..... E04H 3/10

[52] U.S. Cl. ..... 52/6; 52/126.6; 52/143; 404/12; 404/40; 182/152; 182/222; 182/178; 182/92

[58] Field of Search ..... 403/255, 187, 328, 12; 404/40; 182/152, 222, 178, 92; 211/188, 194; 256/67; 160/268, 382, 383, 391, 395, 399; 52/7, 8, 9, 6, 143, 126.6

[56] References Cited

U.S. PATENT DOCUMENTS

| | | | |
|---|---|---|---|
| 2,380,692 | 7/1945 | Gunnison | 52/126.6 |
| 2,602,012 | 7/1952 | Doty | 403/255 |
| 2,944,780 | 7/1960 | Monk | 211/188 |
| 3,011,586 | 12/1961 | Harvey | 182/152 |
| 3,181,203 | 5/1965 | Wenger | 52/7 |
| 3,217,366 | 11/1965 | Wenger | 52/143 |
| 3,235,926 | 2/1966 | Mates | 24/306 |
| 3,416,282 | 12/1968 | Daugherty | 52/823 |
| 3,489,085 | 1/1970 | Kirkpatrick | 160/395 |
| 3,503,166 | 3/1970 | Nakazawa | 52/126.6 |
| 3,504,766 | 4/1970 | Boyd | 182/152 |
| 3,572,224 | 3/1971 | Perry | 404/40 |
| 3,606,704 | 9/1971 | Denton | 52/167 |
| 3,608,937 | 9/1971 | Nave | 403/327 |
| 3,632,154 | 1/1972 | Woodrich | 160/368 R |
| 3,747,706 | 7/1973 | Paine | 182/152 |
| 3,788,608 | 1/1974 | Raymond | 52/9 |
| 3,813,179 | 5/1974 | Priest | 52/710 |
| 3,968,606 | 7/1976 | Facemire | 52/6 |
| 4,103,463 | 8/1978 | Dixon | 52/143 |
| 4,308,963 | 1/1982 | Worrallo | 211/153 |
| 4,403,366 | 9/1983 | Lucke | 24/306 |
| 4,409,762 | 10/1983 | Raymond | 52/9 |
| 4,431,082 | 2/1984 | Bott | 182/127 |
| 4,462,485 | 7/1984 | Terry | 182/91 |

FOREIGN PATENT DOCUMENTS

| | | | |
|---|---|---|---|
| 518889 | 5/1930 | Fed. Rep. of Germany | 52/8 |
| 3114590 | 10/1982 | Fed. Rep. of Germany | 52/6 |
| 2501267 | 9/1982 | France | 182/222 |
| 141702 | 3/1979 | German Democratic Rep. | 403/327 |
| 1340185 | 12/1973 | United Kingdom | 52/126.6 |
| 1432075 | 4/1976 | United Kingdom | 52/126.6 |

*Primary Examiner*—Henry E. Raduazo

*Attorney, Agent, or Firm*—Barnes, Kisselle, Raisch, Choate, Whittemore & Hulbert

[57] ABSTRACT

A stage system and apparatus for construction of flat stages, choral risers, and the like which utilizes a basic structural flat rectangular panel module with an edge of extruded material having a re-entrant groove on the outer surface and upper and lower sockets on each side of each corner of the panel to receive support legs fashioned to be received in the bottom sockets. Railing stanchions are provided to seat in the top sockets. In the vertically spaced and overlapping choral risers, the top sockets serve to locate the overlap and mechanically lock the panels in an overlap position. Inserts received in the re-entrant groove interengage with the re-entrant groove of an adjacent panel to provide lateral and vertical stability to adjacent panels.

Special leg brackets are provided to engage the bottom sockets of two to four adjacent module panels to provide vertical support and lateral retention. Leg assemblies can be formed as a folding frame to facilitate shipping and storage. An interlock is provided between legs and sockets. Cable stabilization is provided with a cam tightening unit.

A railing structure is provided to be supported in upper sockets and arranged for horizontal or angled railings. Step units are provided to interlock with the re-entrant grooves of the panel edges. Velcro clips are also received in the panel grooves to support skirt curtains. A special roller accessory also mounts in the panel grooves to facilitate moving of the panels.

7 Claims, 67 Drawing Figures

FIG. 8
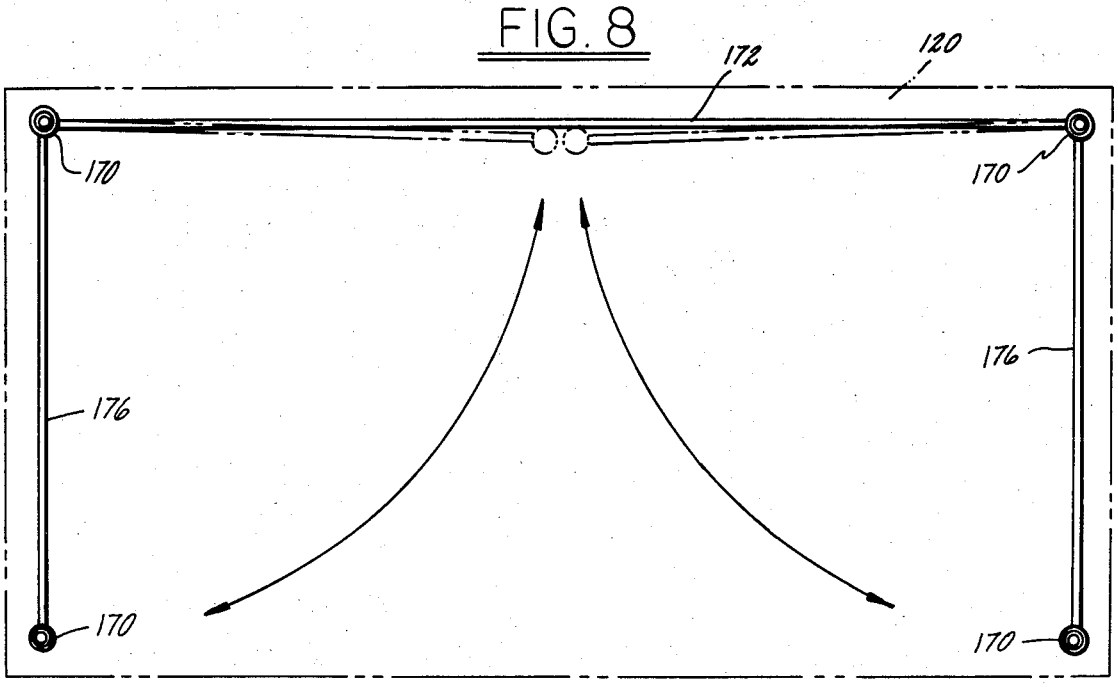
FIG. 9
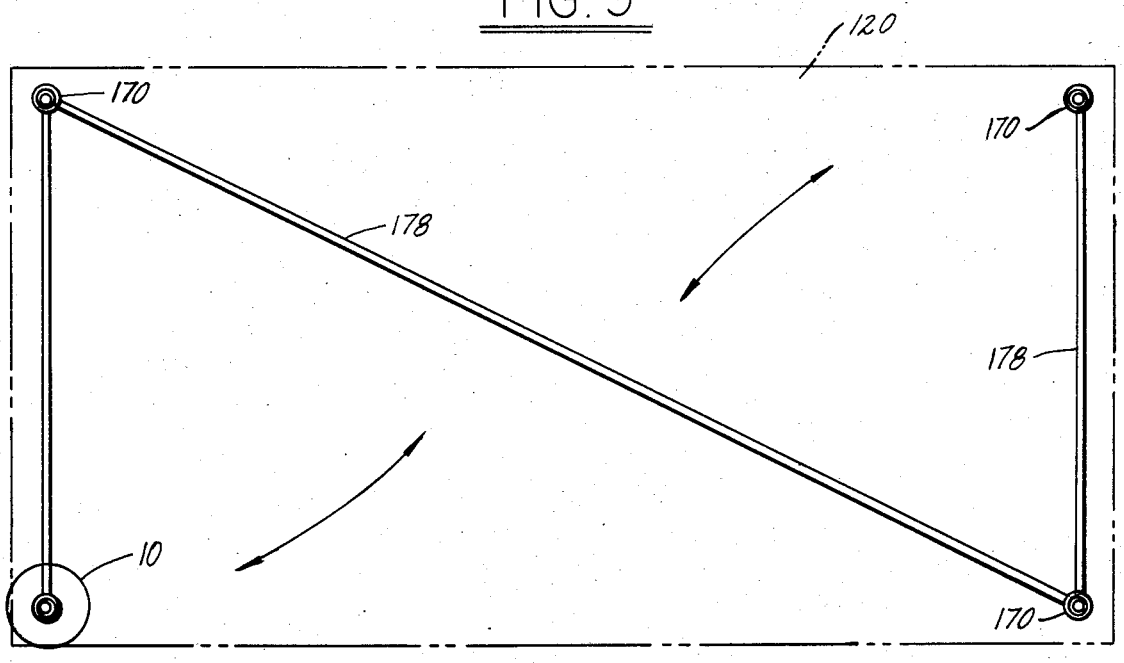
FIG. 10
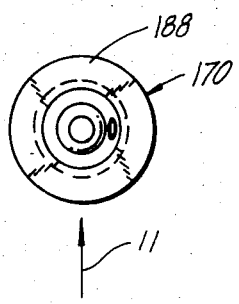
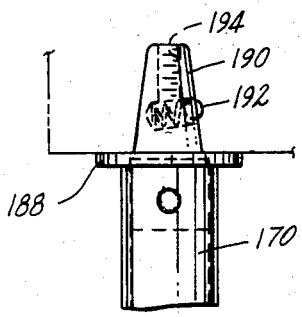
FIG. 11

FIG.29
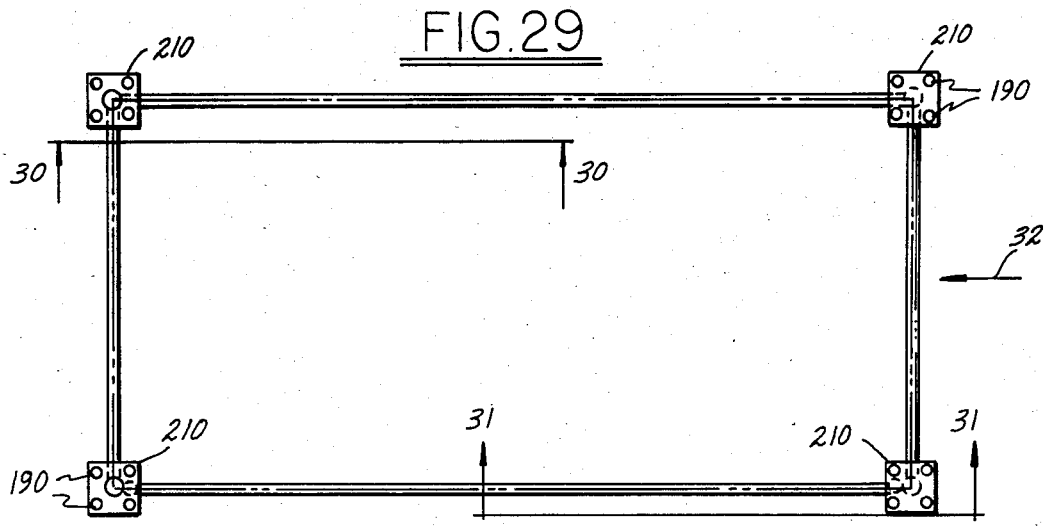
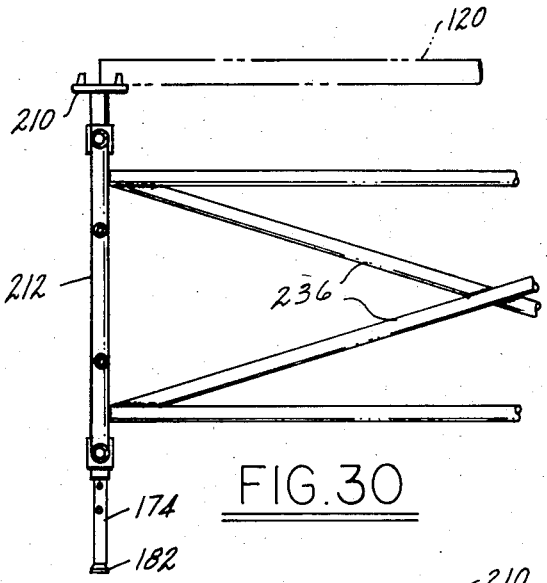
FIG.30
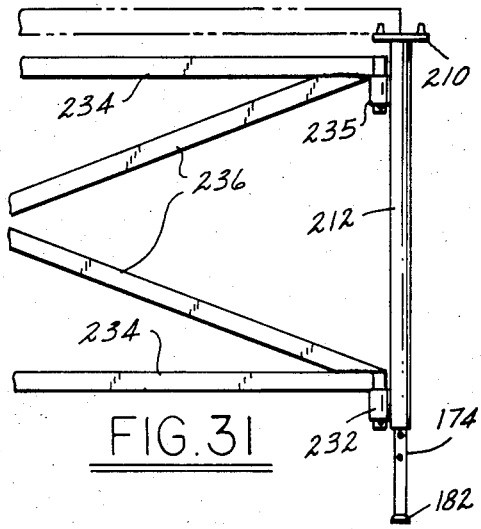
FIG.31
FIG.32
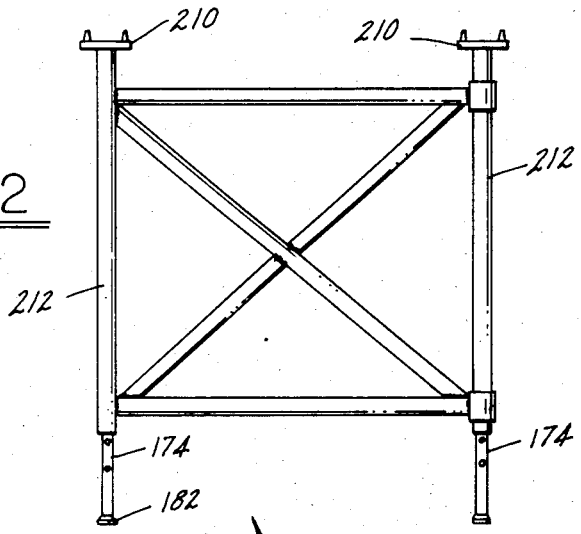
FIG.33
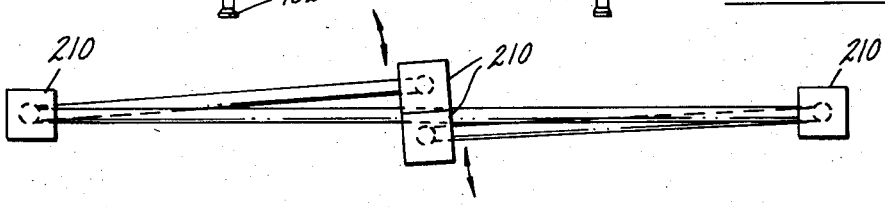

256

252
254
250
36
120

37
290
45
294
288
258
256

FIG.52
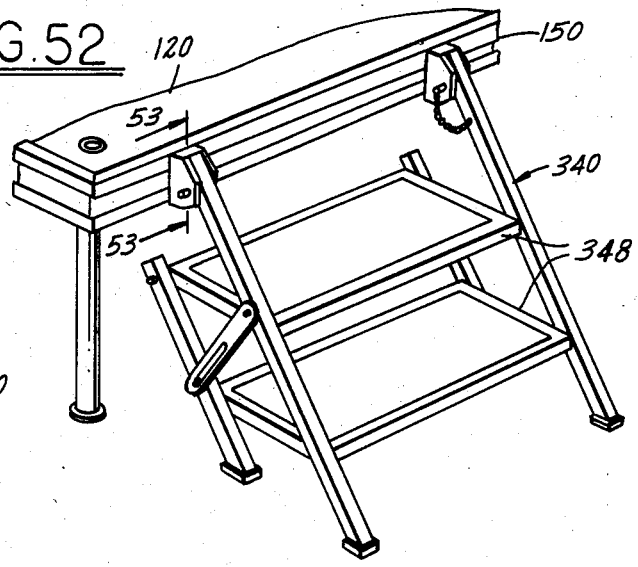
FIG.53
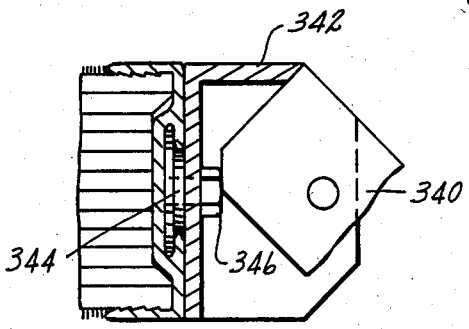
FIG.54
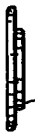
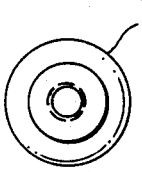
FIG.55
FIG.56
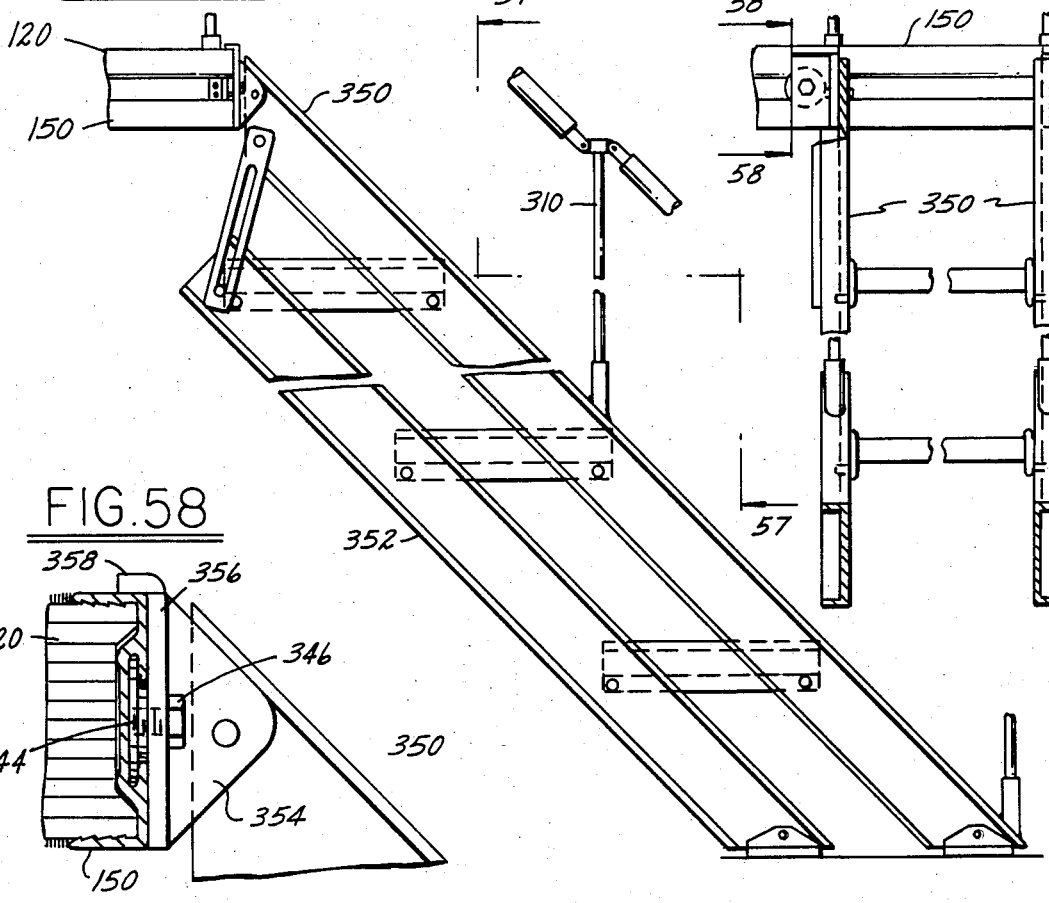
FIG.57
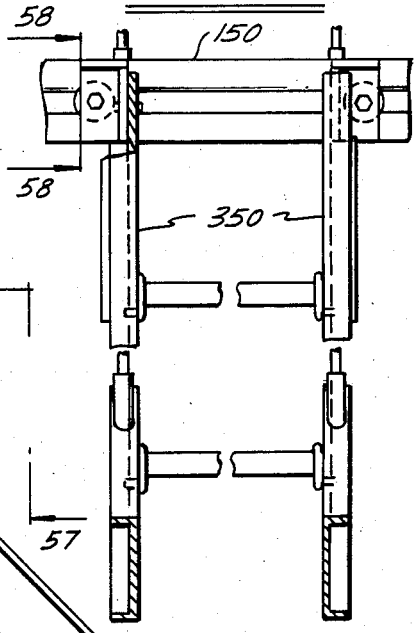
FIG.58

FIG. 59
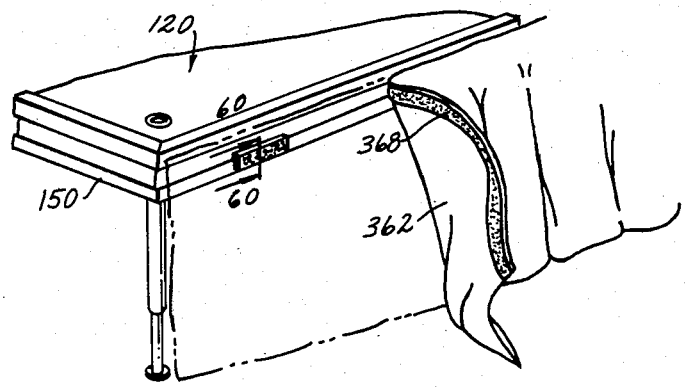
FIG. 61
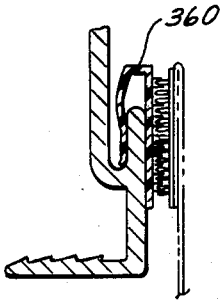
FIG. 60
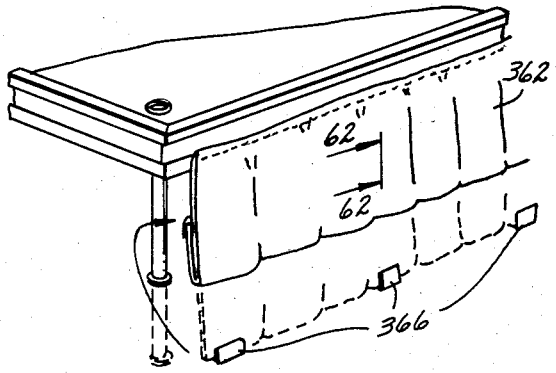
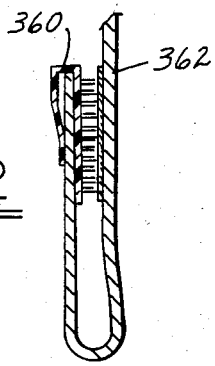
FIG. 62
FIG. 63
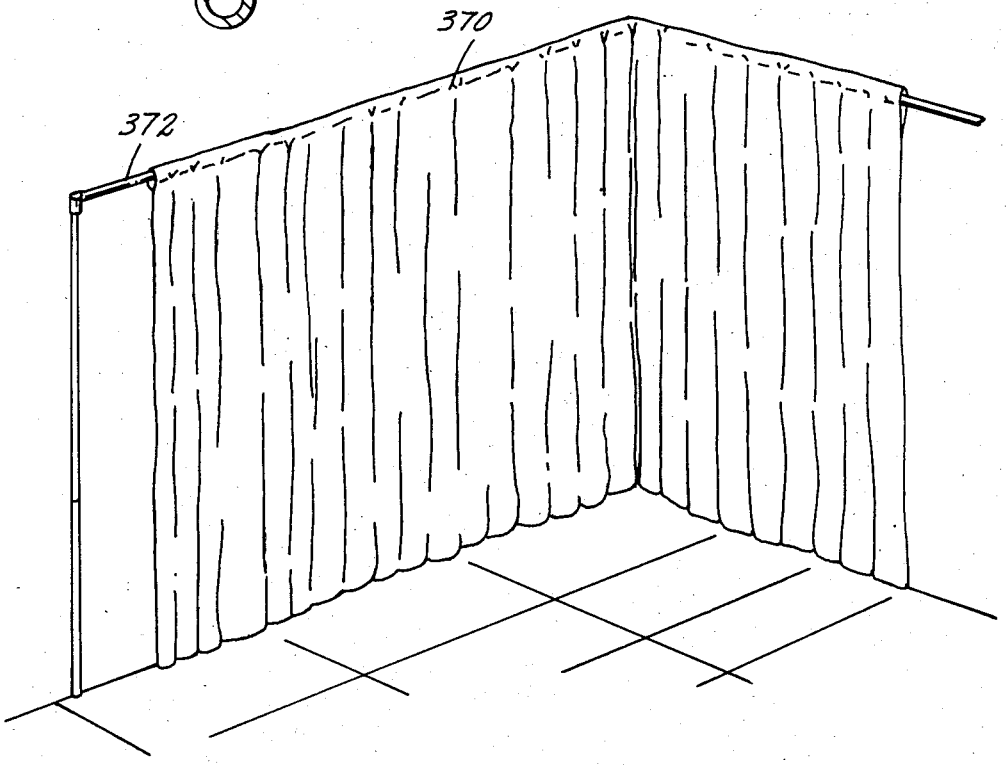

STAGING STRUCTURE

FIELD OF THE INVENTION

The manufacture and assembly of modules for the building of staging for theratrical events, choral presentations, orchestral events and major events such as rock groups.

Background and Features of the Invention

Theaters, music auditoriums, schools, and churches have a need for a variety of staging structures for the presentation of small plays, choral events, orchestras and other public showings where a stage or a series of risers is needed. The needs will vary depending on the size of the group being presented. A permanent structure is unsatisfactory because of this need for flexibility.

The present invention is directed to staging modules and associated hardware which can be purchased in varying quantities and sizes by an organization and which can be variously used as a flat stage or choral risers or a combination of these structures.

Other objects and features of the invention will be apparent in the following description and claims taken with the drawings wherein the invention is described and details provided to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as follows:

FIG. 8, a bottom view of a module showing a leg support frame work.

FIG. 9, a view of a modified leg support frame work.

FIG. 10, an enlarged top view of a leg support shown at circle 10 in FIG. 9.

FIG. 11, a side elevation of the top of a leg support taken at arrow 11 of FIG. 10.

FIG. 29, a view of a single module with corner leg support plates assembly.

FIG. 30, a sectional view on line 30—30 of FIG. 29.

FIG. 31, a sectional view on line 31—31 of FIG. 29.

FIG. 32, an end view at arrow 32 of FIG. 29.

FIG. 33, a top view of a folded leg frame.

FIG. 52, a view of a short stair assembly for a low platform.

FIG. 53, a section on line 53—53 of FIG. 52.

FIG. 54 and 55, side and elevation views of an attachment disc for a stair assembly.

FIG. 56, a larger stair assembly for a riser platform.

FIG. 57, a partial section at line 57—57 of FIG. 56.

FIG. 58, a detail on line 58—58 of FIG. 57.

FIG. 59, an illustration of a Velcro curtain suspension.

FIG. 60, a section on line 60—60 of FIG. 59.

FIG. 61, a view of a curtain adjustment system.

FIG. 62, a section on line 62—62 of FIG. 61.

FIG. 63, an optional rail curtain.

DETAILED DESCRIPTION OF THE INVENTION AND THE MANNER AND PROCESS OF USING THE SAME

Figure 1:
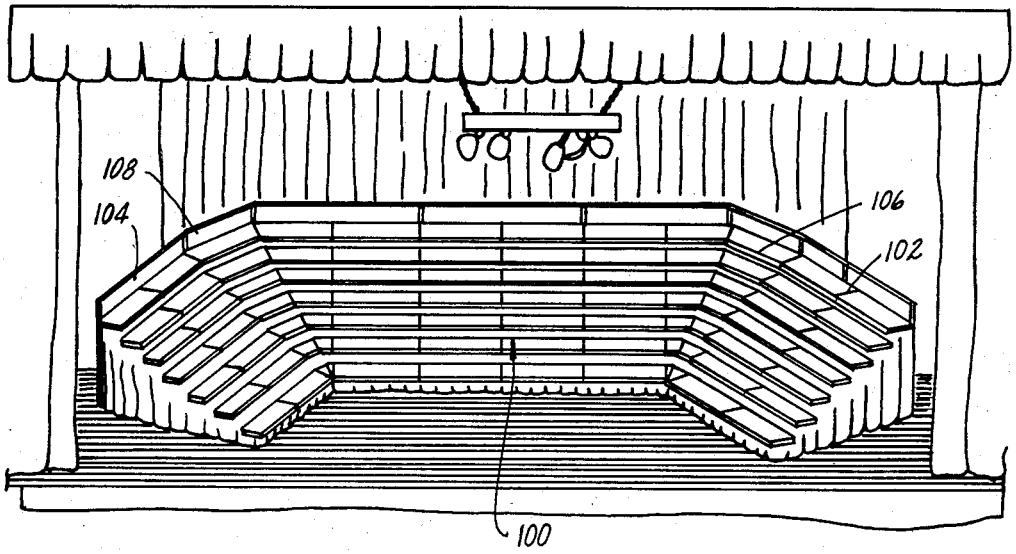
FIG. 1, a perspective view of a staging riser for a relatively large choral group.
Figure 2:
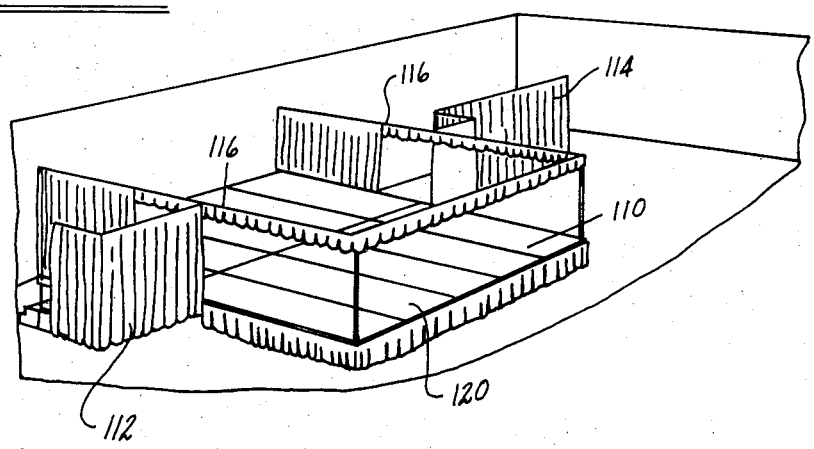
FIG. 2, a view of a small stage.
Figure 3:
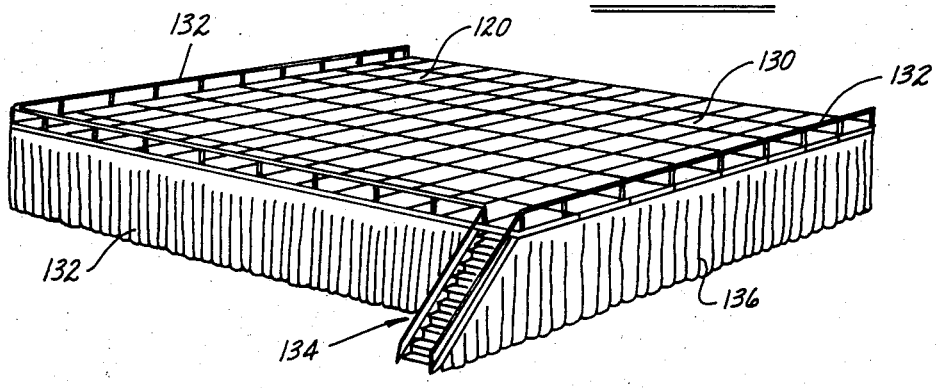
FIG. 3, a view of a flat raised stage for large groups.

With reference to the drawings, FIGS. 1, 2 and 3 show various elements of staging which can be constructed from the modules of the present invention.

FIG. 1 illustrates a stage with a riser for choral groups with a section 100 and two end sections 102 and 104 angled to the back section and connected thereto by angled spacers 106 and 108. In FIG. 2, a simple low stage 110 is provided which can be used for a children' drama and the like with curtain portions 112 and 114 and a railing 116. This stage 110 is made up of multiple modules 120, rectangular in shape, and joined as will be described later.

In FIG. 3, a large staging area 130, made up of multiple modules 120, can be used for large affairs such as rock groups and the like, this unit also having railings 132 and a stair assembly 134, the staging being surrounded by suitable curtains 136.

Figure 4:
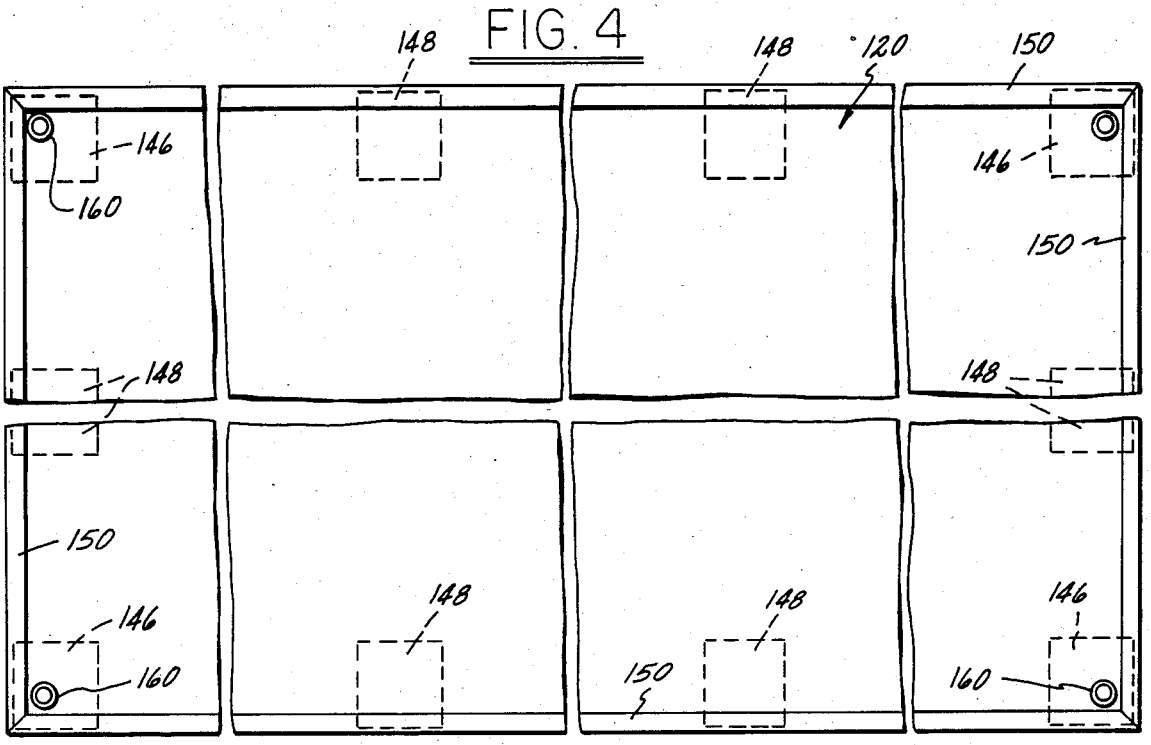
FIG. 4, a view of a rectangular module utilized as a horizontal support in a staging structure.
Figure 13:
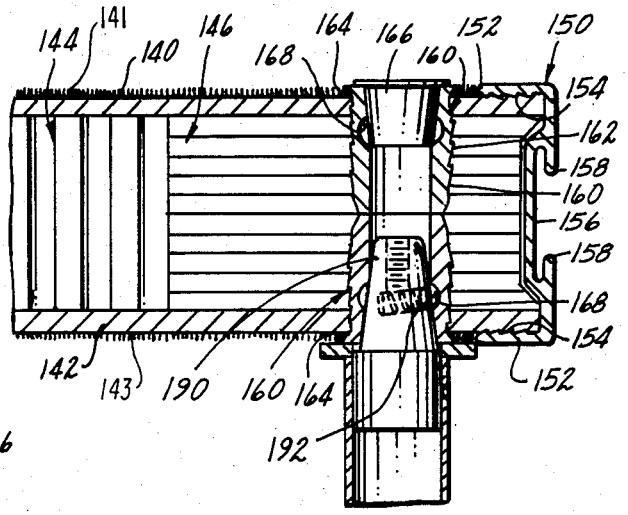
FIG. 13, a sectional view on line 13—13 of FIG. 12.
Figure 12:
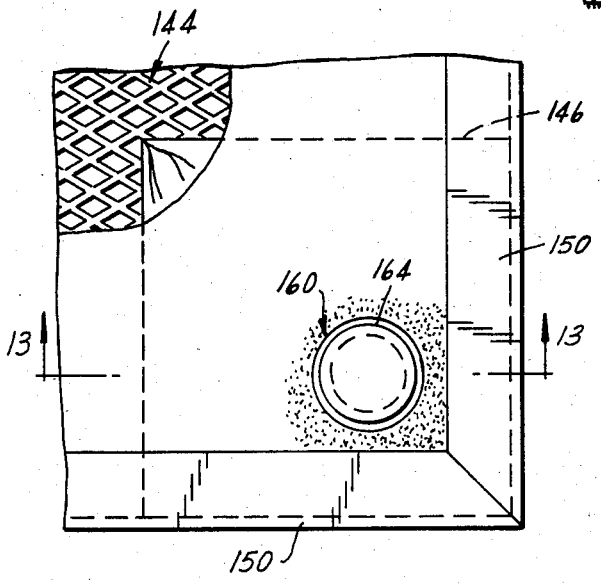
FIG. 12, an enlarged view of a corner of a support module.
Figure 12:
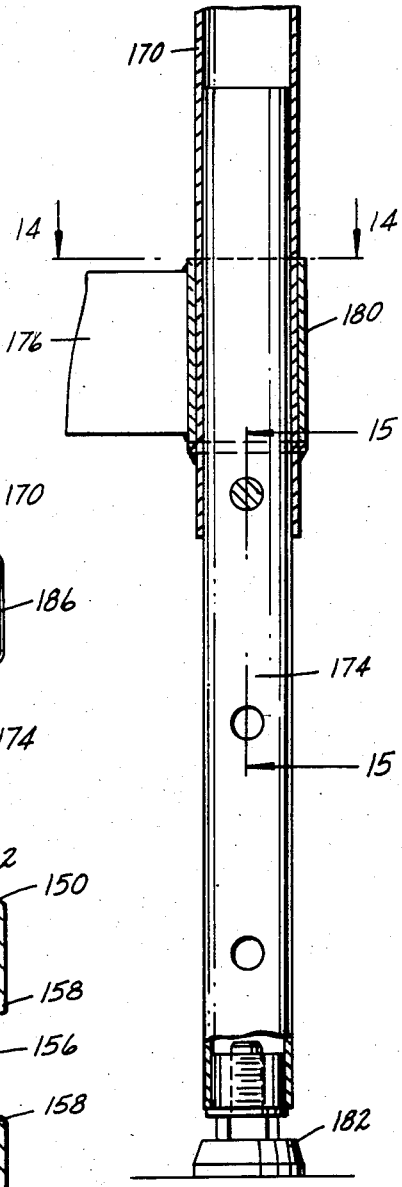
Figure 14:
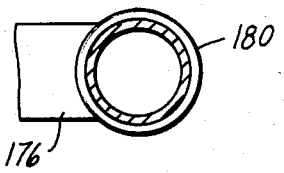
FIG. 14, a section on line 14—14 of FIG. 13.
Figure 17:
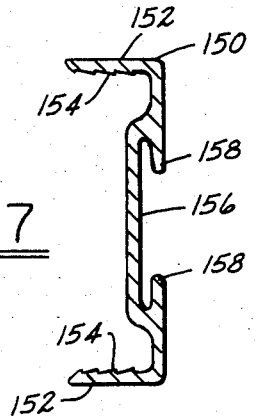
FIG. 17, a sectional view of a support module edge plate.

In FIG. 4, the support module 120 is illustrated broken away to enable the showing on a single sheet. A partial section of this module is shown in FIG. 13 wherein a top panel 140 is spaced from a bottom panel 142 and the space between these panels being filled by a plastic or paper honeycomb material 144, the axis of the honeycomb openings being perpendicular to the panels. The panel surfaces may be covered with carpet 141 on one side and vinyl 143 on the other side so that either may be used as the exposed top surface. In each corner of the module is a reinforcement stack 146 which can be formed of pieces of plywood glued together and recessed into the filler material at each corner. Similar reinforcing stacks can be provided along the edges of the module as shown at 148 in FIG. 4. The edges of the module are closed by an extruded elongate strip 150 (FIG. 17) which has two parallel flanges 152 extending from one side of the strip. These flanges are preferably provided with saw-tooth ridges 154 as illustrated in FIG. 13 and extending the length of the edge piece 150. This edge piece is forced on to the modules by hydraulic or other presses so that the flanges 152 are firmly engaged with the upper and lower panels 140 and 142. The edge pieces each have on the outer surface a re-entrant slot 156 with vertically spaced upper and lower flanges 158. The purpose of this groove will be later described.

Figure 16:
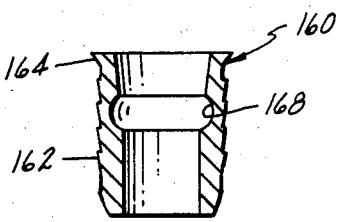
FIG. 16, a sectional view of a module leg socket.

At each corner of the module 120, recessed into the reinforcing blocks 146, are sockets 160 (See FIG. 16) preferably formed of metal such as aluminum and also having saw-tooth annular ridges 162 on the outer surface so that when forced into a hole in the blocks 146, they will be securely retained. The entrance end of the socket is tapered to facilitate the assembly and the outer end of the socket has a tapered flange 164. In FIG. 13, a plastic plug 166 is shown closing the top of the socket. Each socket also has an internal annular groove 168 which will receive a detent part on parts to be assembled therein. These sockets preferably enter the corner from the top and bottom of the support module panel and are coaxial, the inner ends abutting.

Figure 5:
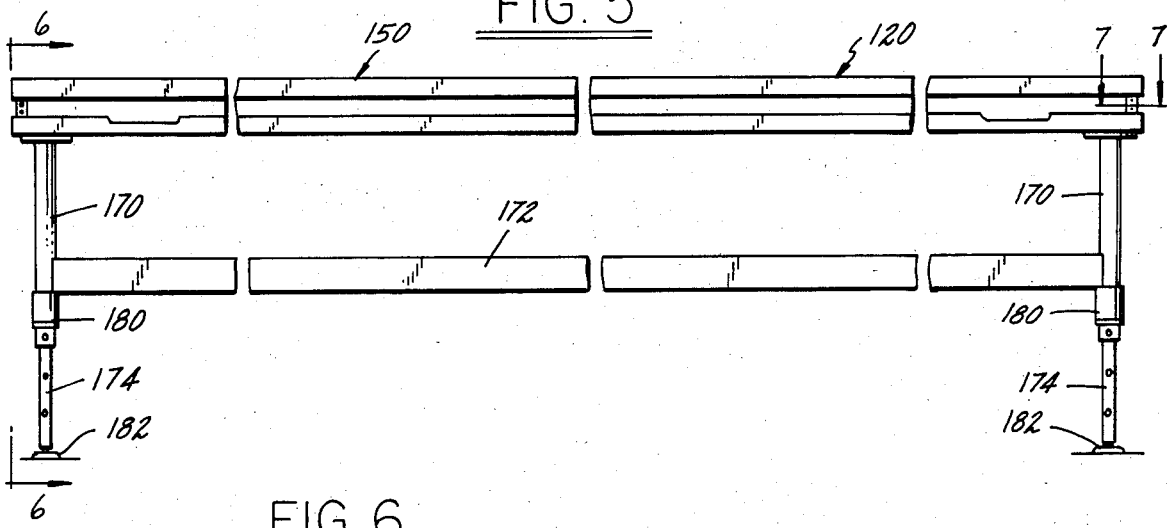
FIG. 5, a side view of the module of FIG. 4 showing leg supports.
Figure 6:
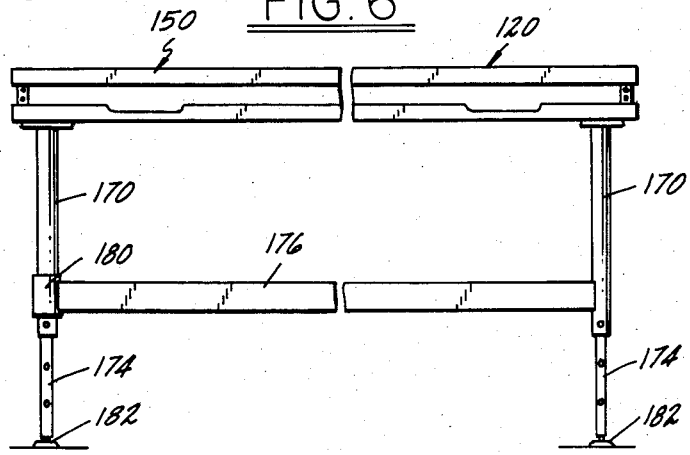
FIG. 6, an end view of the module of FIG. 4 taken on line 6—6 of FIG. 5.
Figure 7:
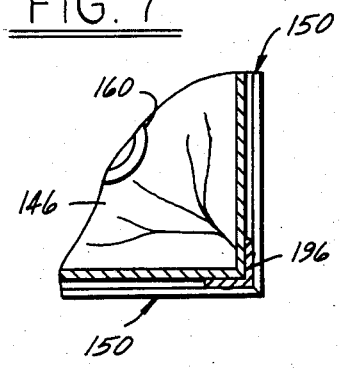
FIG. 7, a sectional view of a corner of a module taken on line 7—7 of FIG. 5.

Reverting to FIG. 5, the support module 120 is shown supported by leg elements 170 which are connected by a cross-brace 172. A side view of the assembly is shown in FIG. 5 and an end view is shown in FIG. 6. The legs have an extensible telescoping section 174 which can be adjustably positioned within the legs and as shown in FIG. 8, the legs 170, four in number, are connected by the horizontal strut 172 and by shorter struts 176. The shorter struts can be folded to the longer section as shown in FIG. 8 for shipping purposes.

A modified leg structure is shown in FIG. 9 in which the shorter horizontal struts are connected by a diagonal structure 178. This frame work can also be collapsed as shown by the arrows. It will be appreciated that the horizontal end struts are pivoted on suitable sleeves 180 surrounding the legs in such a way that the frame work can be collapsed as described. Each telescoped leg portion 174 has an adjustable foot 182 to contact a supporting surface.

Figure 15:
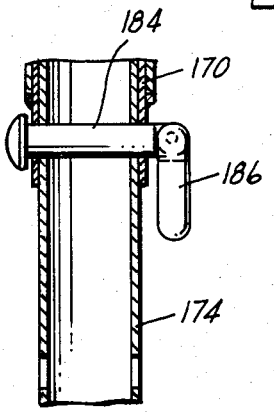
FIG. 15, a section on line 15—15 of FIG. 13.

In FIG. 15, the means for locking the telescoping portions 174 to the leg portion 170 is shown in the form of a headed bolt 184 which has a pivoted retainer latch 186. The top pf the leg portions 170 is illustrated in FIG. 10 and in FIG. 11. A flange 188 is positioned at the top of the leg and a conical projection 190 extends upwardly from the flange having a spring-backed backed ball detent 192 which will cooperate with the annular recesses 168 of the sockets 160. A threaded recess 194 at the top end of the conical portion allows a securing bolt to be received when dictated by the particular use.

Figure 18:
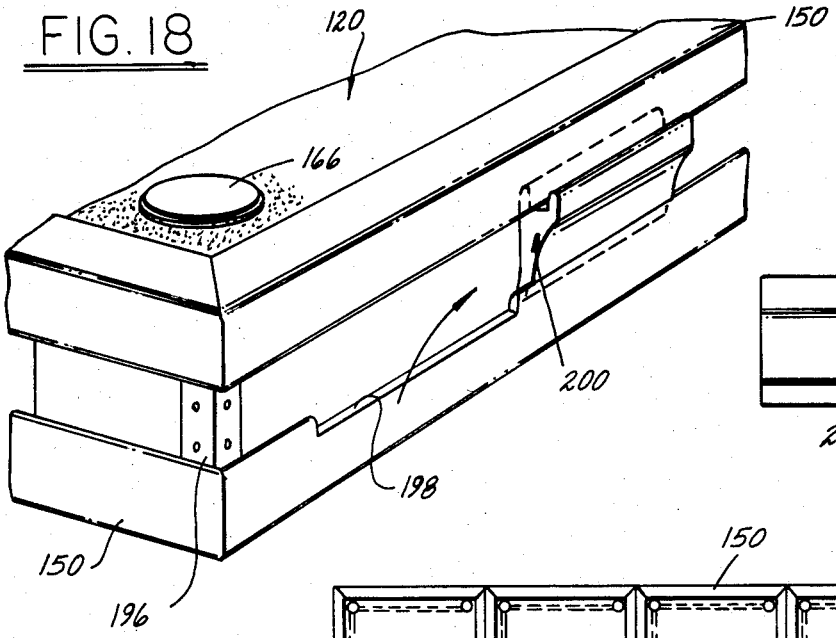
FIG. 18, a perspective view of a corner of a support module showing a re-entrant groove.
Figure 19:
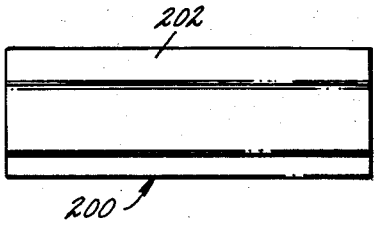
FIG. 19, a side elevation of a support clip used in an edge plate.

In FIG. 18, a perspective view of a corner of a support module 120 is illustrated, the extruded edge strips 150 being also illustrated. A short angle piece 196 is illustrated which may be utilized for further vertical closure of the corners of the unit. This angle piece 196 is shown in FIGS. 5, 6, 7 and 18. The inner side of the edge pieces 150, and particularly the re-entrant groove shape, is recessed to receive a side or wing of the angle 196 and this angle is pop-riveted to the ends of the conjunctive edge pieces at the corners so the edge pieces are mechanically locked together at the corners of the panel module. In FIG. 18, the socket 160 is closed by the plastic plug 166. The re-entrant groove 156 has a notched portion 198 to admit the entrance of a vertical support element 200. This element hsa a bottom edge which will be received in the lower portion of the re-entrant groove and a bifurcate top edge 202, the inner portion of which is received in the upper portion of the re-entrant groove and the outer portion is spaced outwardly.

Figure 20:
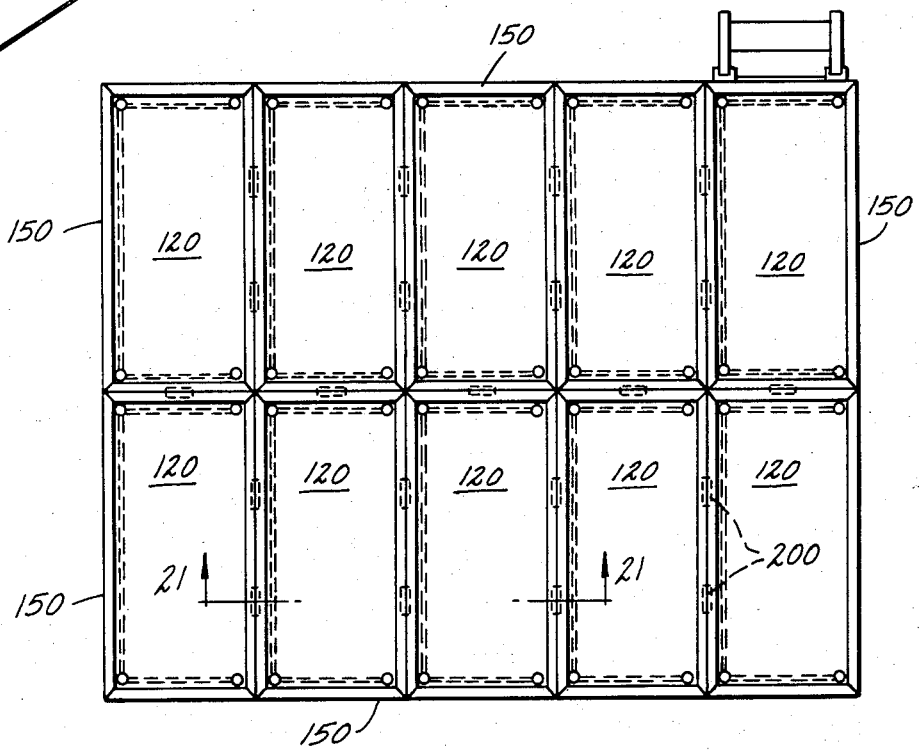
FIG. 20, a plan view of a small stage with ten support modules.
Figure 21:
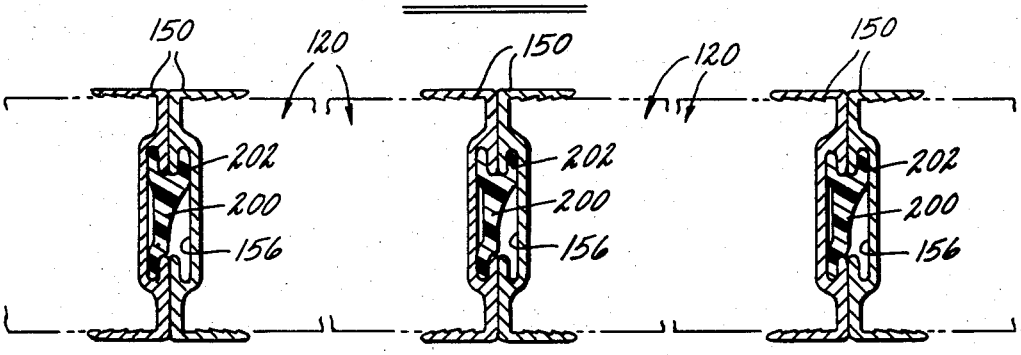
FIG. 21, a sectional view on line 21—21 of FIG. 20.

When a small number of support modules 120 are to be secured together, as shown in FIG. 20, the edges may be secured to each other by the elements 200, as shown best in FIG. 21. It will be seen that the re-entrant grooves 156 in each case are facing each other and the element 200 is secured in one of the re-entrant grooves and the outer portion of the bifurcate upper edge is hooked into the re-entrant groove of an adjacent edge strip. Thus, the panels are locked together horizontally and furnish multiple vertical support for each other. Suitable leg supports can be utilized as previously described.

Figure 22:
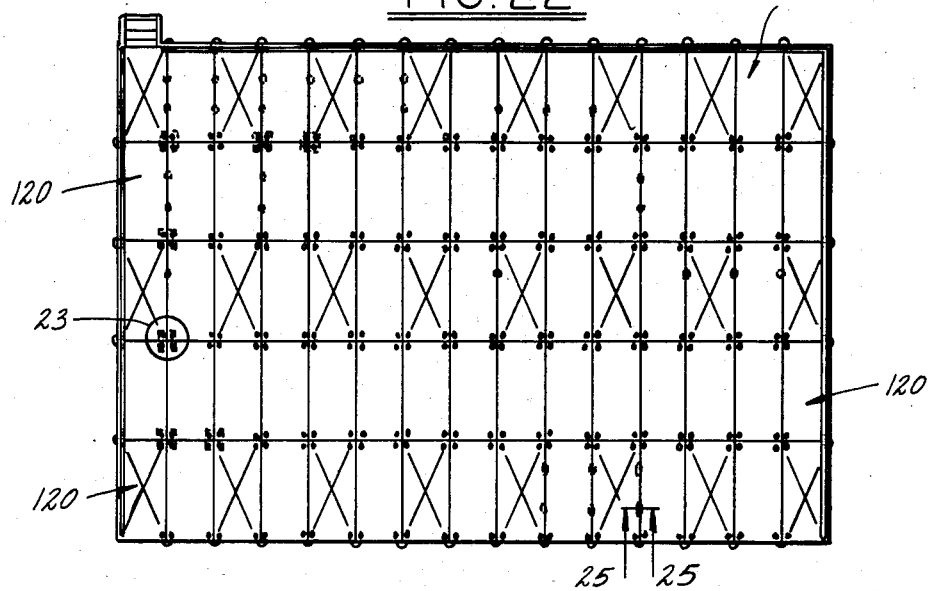
FIG. 22, an assembly plan of a large staging.
Figure 24:
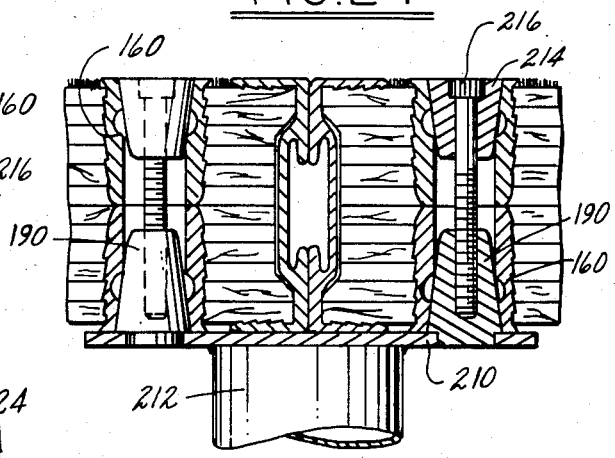
FIG. 24, a section line line 24—24 of FIG. 23.

In FIG. 22, a larger staging assembly is shown composed of a multiplicity in each direction of the support modules 120. In this structure, the corners of the various modules are interlocked by a leg plate which has four upstanding projections to be received in the sockets 160 on the bottom of the corners of the modules. In this system, a different leg is utilized as shown best in FIGS. 29 to 33. Where four corners are to be joined, each leg has a square panel 210. As shown in the sectional view of FIG. 24, the leg tube 212 has the top portion welded to a square panel 210 with conical inserts 190 described in connection with FIGS. 10 and 11 but having a shorter vertical dimension to facilitate the assembly. In this structure, the top socket 160 has an insert 214 through which a headed bolt 216 is passed to thread into the threaded recess of the part 190.

Figure 23:
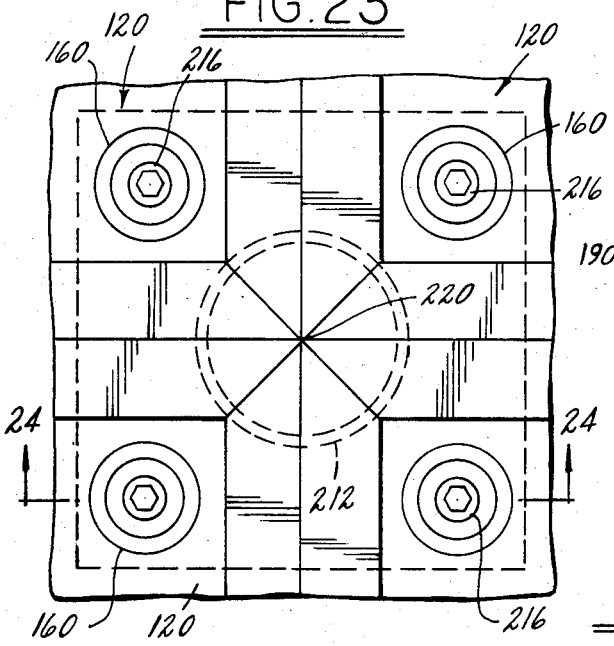
FIG. 23, an enlarged view of a corner junction circled at 23 in FIG. 22.

As shown in FIG. 23, the four corners of modules 120 meet at point 220 and the bolts 216 are illustrated. Thus, the four corners are mechanically secured together.

The circle 23 in FIG. 22 encircles one of the four corner assemblies which is enlarged in FIG. 23. It will be understood that in the assembly shown in FIG. 22, only every other panel needs to have a leg section, the intervening panels being supported by the adjacent panels. In each case, it is preferable that there be an odd number of modules in each direction to accomplish this. However, if an even number is a requirement, adapter legs can be provided.

Figure 25:
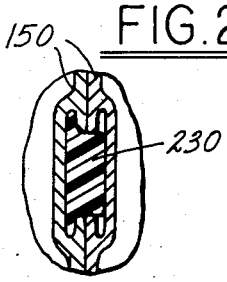
FIG. 25, a section on line 25—25 of FIG. 22.
Figure 27:
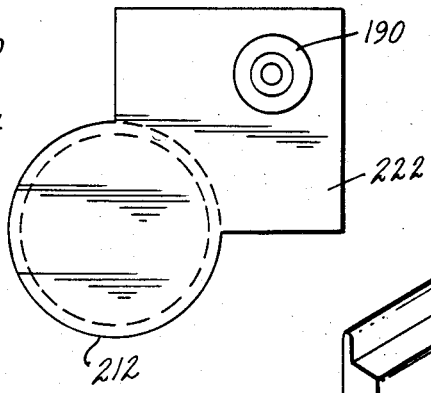
FIG. 27, a view of a corner leg support bracket.
Figure 28:
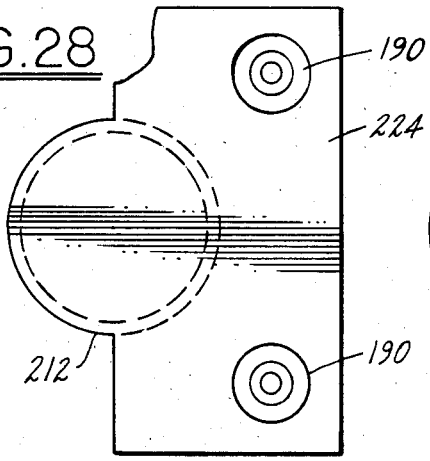
FIG. 28, a view of a side leg-support bracket.
Figure 26:
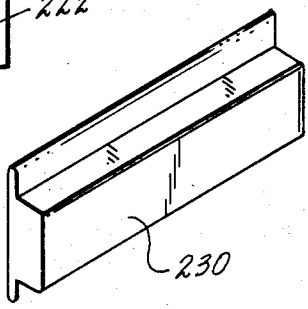
FIG. 26, a perspective view of a vertival load-share block.

At the external corners, a special unit can be used as shown in FIG. 27, where the leg 212 has a quartered plate 222 with a single projection 190. For the side edges, the leg tube 212 can have a half plate 224 with two upward projections 190. To provide an additional vertical load-carrying function, a block 230, shown in FIG. 26, is inserted in one of the reentrant grooves of an edge plate and projects into an adjacent reentrant groove as illustrate in FIG. 25. The shorter cones 190 allow the blocks 230 to be inserted between adjacent panels and the panels to be located on the cones in the assembly. The leg frames for a structure illustrated in FIG. 22 are shown best in FIG. 29 where cross-bars are provided to reinforce the structure. These cross-bars can have drop-in sections, as illustrated in FIG. 31, where a recess 232 can receive a downwardly projecting portion of a cross-bar, for example, in FIG. 31, the horizontal cross-bars 234. Diagonal cross-bars 236 may also be utilized for horizontal stability. With the legs 212, as with the previously described legs, telescoping adjustable sections 174 can be used. As shown in FIG. 33, the support frames can also be collapsed for shipping.

Figures 34, 35, 36:
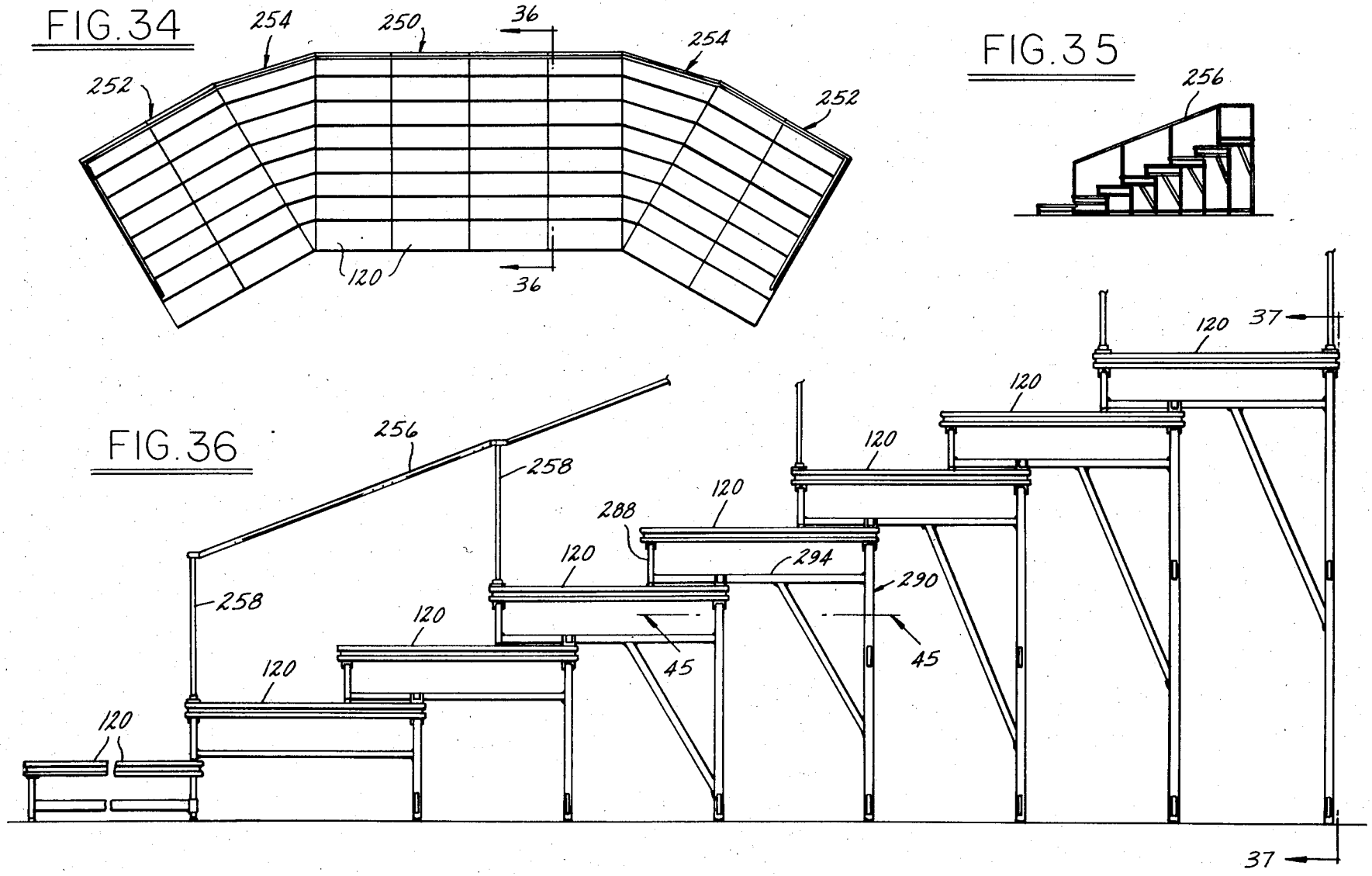
FIG. 34, a vertical plan of a choral staging assembly.
FIG. 35, an end view of the staging of FIG. 34.
FIG. 36, an enlarged section of the assembly of FIG. 34 taken on line 36—36 of FIG. 34.
Figure 37:
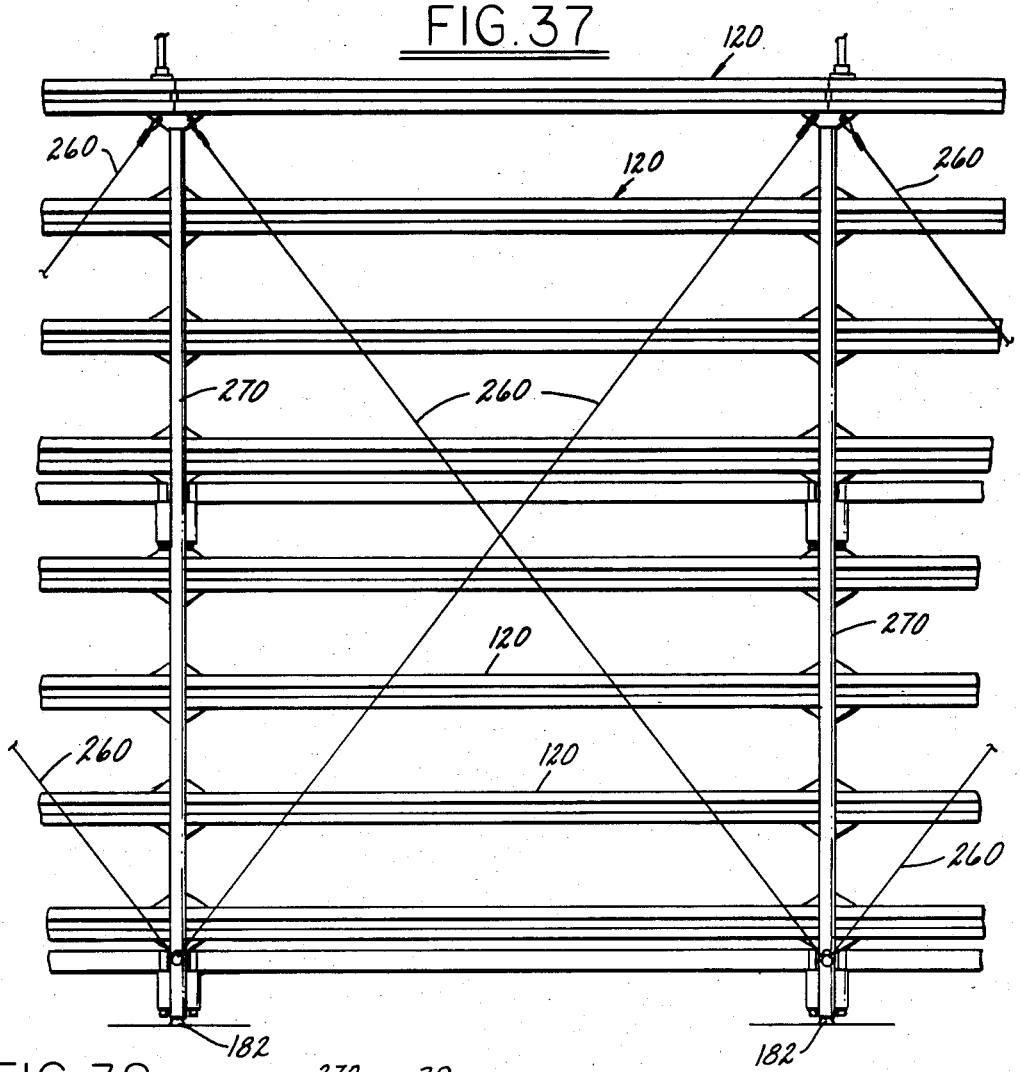
FIG. 37, a rear view of the assembly of FIG. 34 taken on line 37—37 of FIG. 36.
Figure 43:
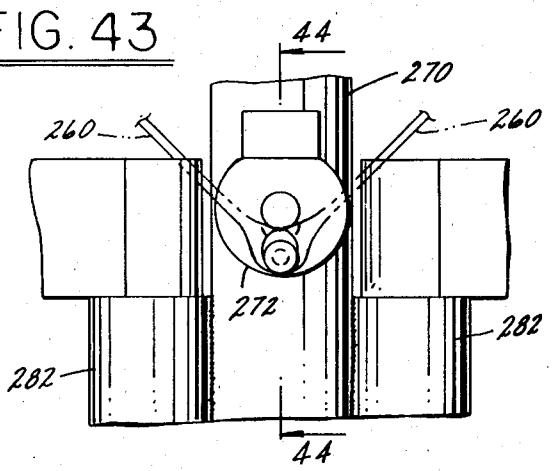
FIG. 43, a view similar to FIG. 42 with a cam cable take-up actuated.

In FIG. 34, there is illustrated a staging unit utilized for choral groups wherein a series of risers provide horizontal support for people standing in line, each line being at a different level than the next. There is, in FIG. 34, a main back section 250, two wing portions 252, and angled connector portion 254. An end view, in small dimension, is illustrated in FIG. 35 with railings 256. A larger view is shown in FIG. 36 wherein a series of support modules 120 are mounted at different levels in overlapping relationship to provide a choral riser. The same support panels are used in this combination as in the previously described embodiments. With the exception of the lowest panel, the next adjacent rising panels each have a long leg support for the rear portion and a short leg support for the front portion which will rest on the next adjacent lower panel. Railing stanchions 258 can insert into the sockets 160 in the outer corners of the various risers. In FIG. 37, cable reinforcing devices utilizing cables 260 can be anchored at various portions to stabilize the unit horizontally. A device is provided to tighten the cables which are anchored at the top. The tightening device is shown in FIGS. 42 and 43 which are enlargements of the encircled portion 42 of FIGS. 37 and 41.

Figure 38:
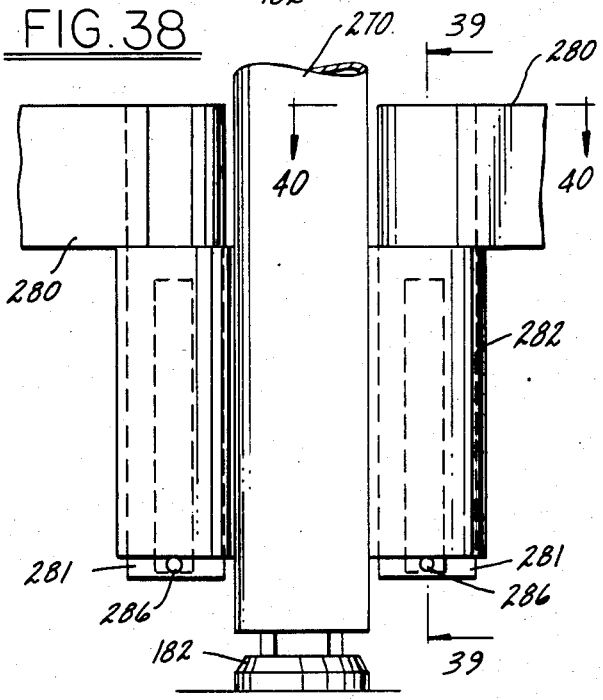
FIG. 38, a view of a leg support structure with cross-bar interlock for horizontal bracing.
Figure 39:
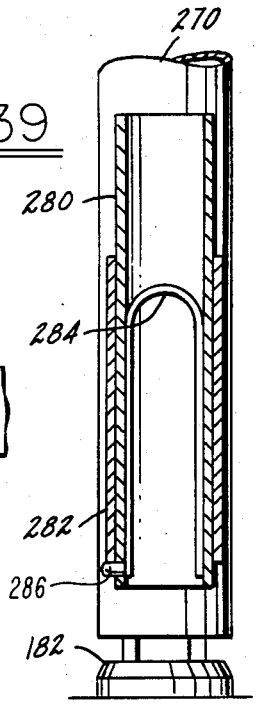
FIG. 39, a section view on line 39—39 of FIG. 38.
Figure 40:
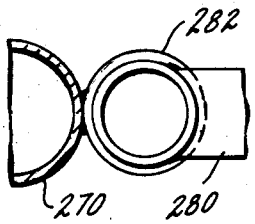
FIG. 40, a sectional view on line 40—40 of FIG. 38.
Figure 41:
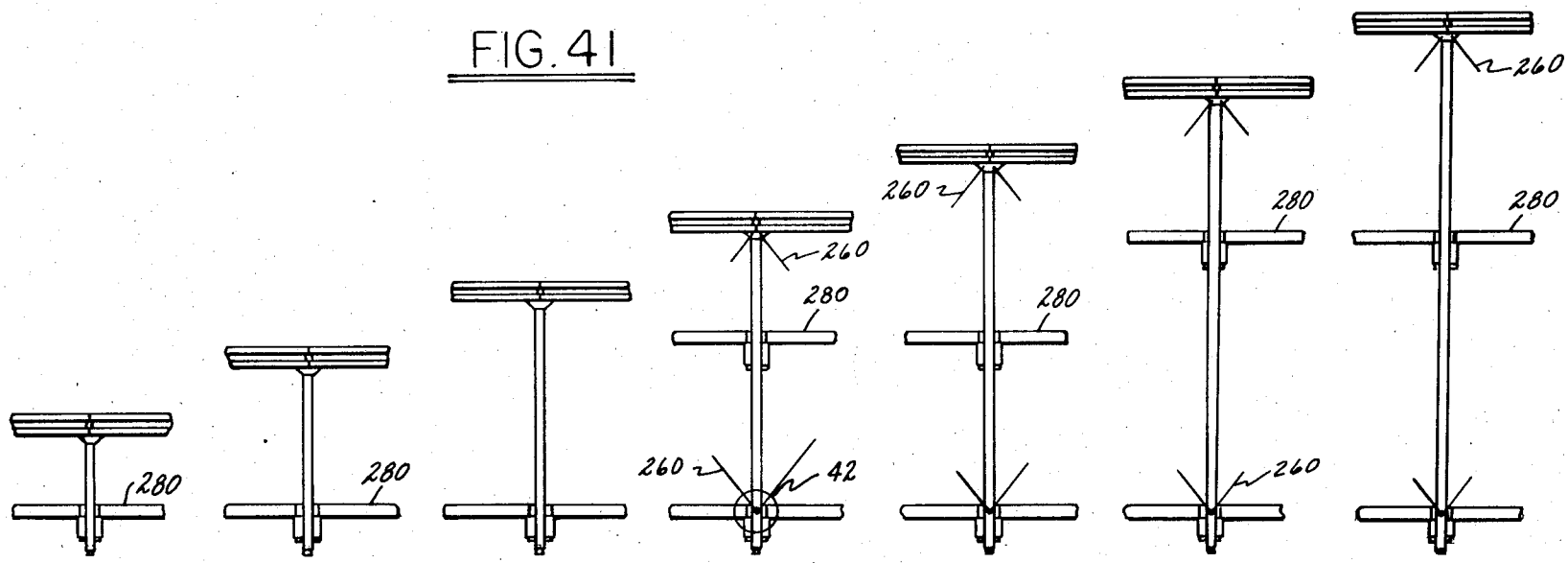
FIG. 41, a view from the back of a riser assembly showing the horizontal bracing.
Figure 44:
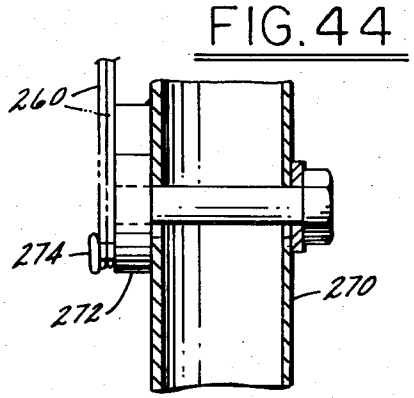
FIG. 44, a sectional view on line 44—44 of FIG. 43.
Figure 42:
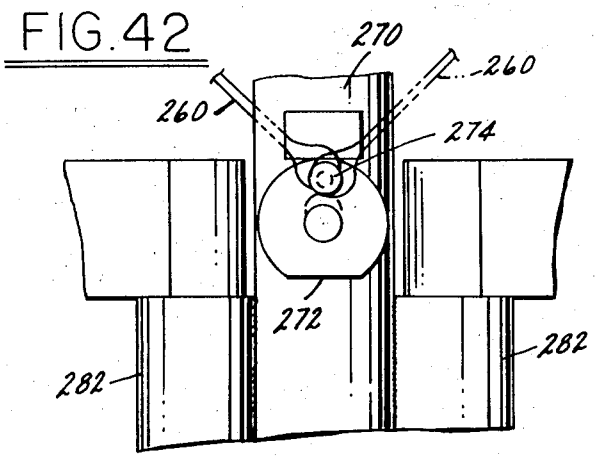
FIG. 42, a view of a cable bracing connection at circled 42 in FIGS. 37 and 41.

With reference to FIG. 42, on a leg portion 270, a circular cam 272 is rotatably mounted and carries an eccentric pivot pin 274 to which the cables are connected. Rotation of the cam as shown in FIG. 43 will tighten the cables 260 to provide the proper tension. Also, as shown in FIGS. 41, 42 and 43, drop-in horizontal bars, referenced generally at 280, have downwardly projecting portions 281 which socket in side mounted tubes 282. See also FIG. 38. In FIG. 39, a U-shaped spring clip 284 with a button 286 is utilized to lock the horizontal bars in place until intentionally released. FIG. 40 shows a section on line 40—40 of FIG. 38.

Figure 45:
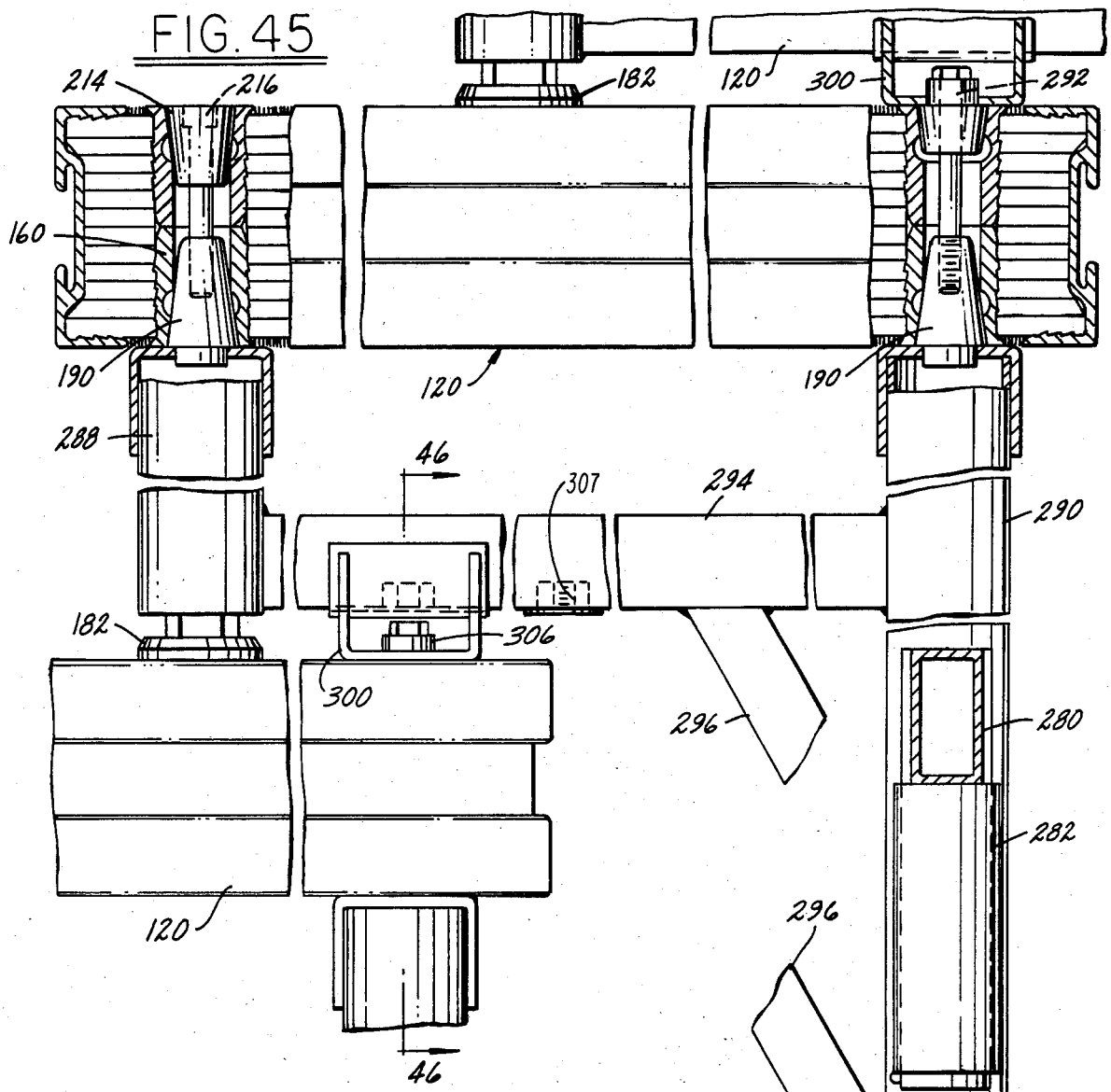
FIG. 45, a sectional view on line 45—45 of FOG. 36 showing the details of the riser overlap and interconnection.
Figure 46:
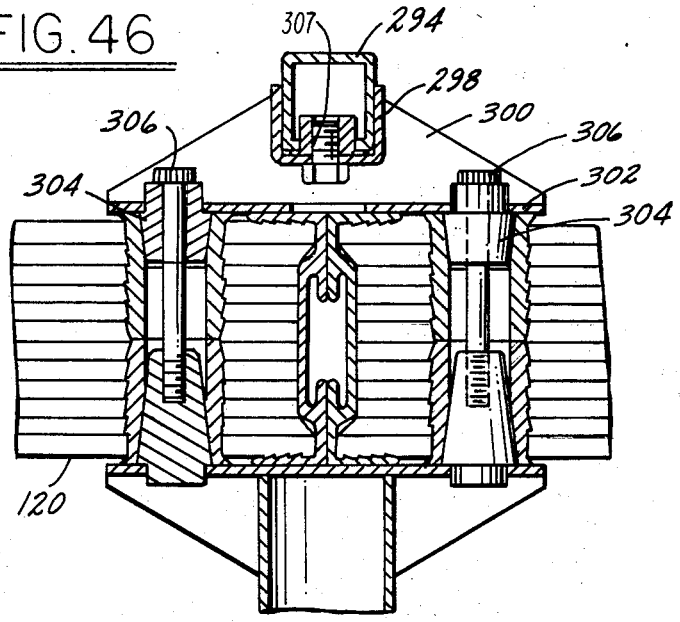
FIG. 46, a sectional view on line 46—46 of FIG. 45.

A more detailed showing of the stepped-in riser construction is found in FIG. 45, a section taken on line 45—45 of FIG. 36. At the top left-hand portion of FIG. 45, it will be seen that the support module 120 has a depending leg 288 with a foot pad 182 resting on the lower module 120. The leg 288 has the conical projection 190 which projects into the socket 160 and is retained by the insert 214 and bolt 216. The longer leg 290 extends down to the supporting surface and also has a projection 190 secured in the support module 120 by a blot 292. A lateral bar 294 connects the legs and is diagonally supported by a strut 296. A sectional view in FIG. 46, taken on line 46—46 of FIG. 45, shows the bar 294 mounted in a yoke 298 supported in a gusset 300 on a plate 302. This plate is secured by plugs 304 and bolts 306 to the support module 120. The yoke 298 is designed to be located at various points along the bar 294. See, for example, the threaded recess 307. Thus, the overlap of the risers can be adjusted as desired and still locked in place. Thus, the risers are secured to each other through the respective corner sockets and supported by the horizontal lateral members as well as by the tightened cables.

Figure 47:
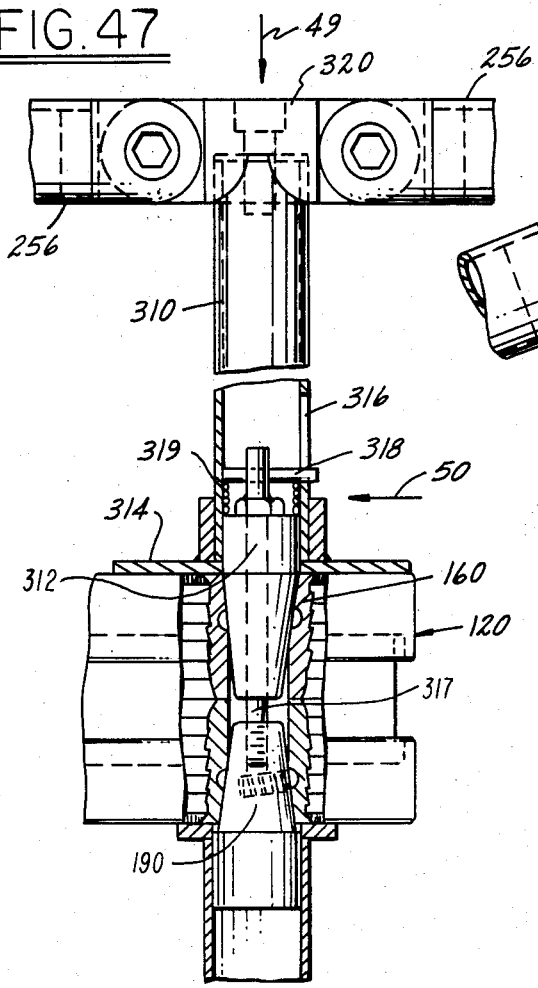
FIG. 47, an illustration of a railing support.
Figure 48:
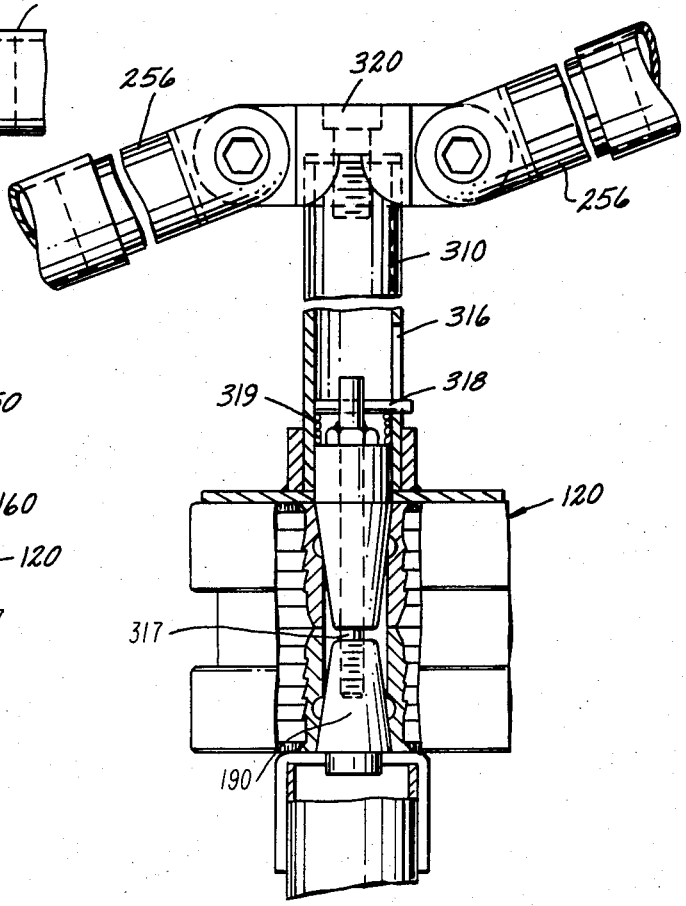
FIG. 48, a view similar to FIG. 47 showing angled railings.
Figure 49:
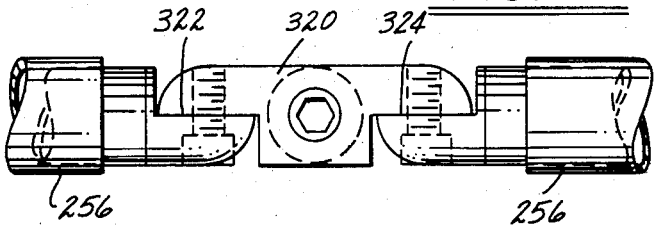
FIG. 49, a top view at arrow 49 of FIG. 47.
Figure 50:
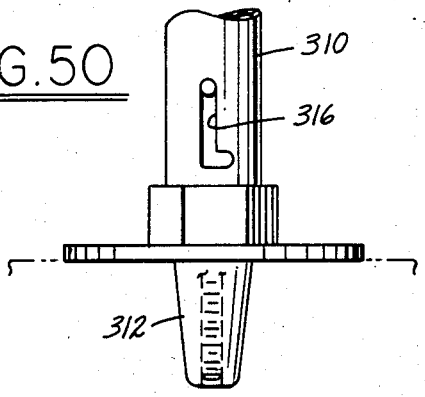
FIG. 50, a view at arrow 50 on FIG. 47.
Figure 51:
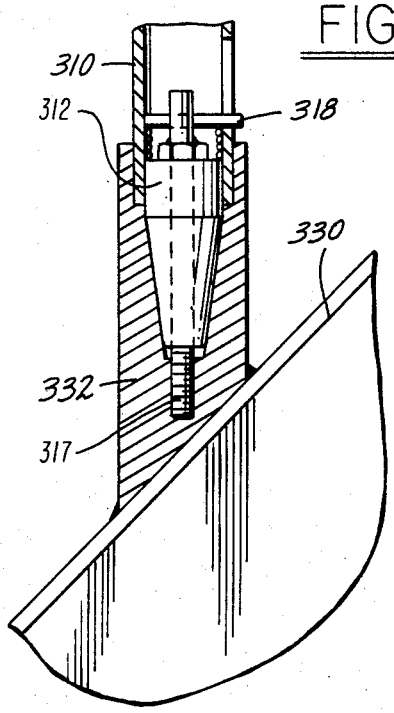
FIG. 51, a view of a railing stanchion for a stair rail.
Figure 64:
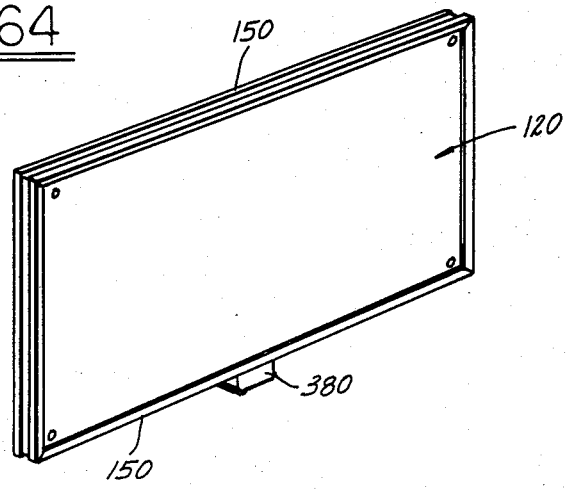
FIG. 64, a view of a support module with a roller accessory.
Figure 65:
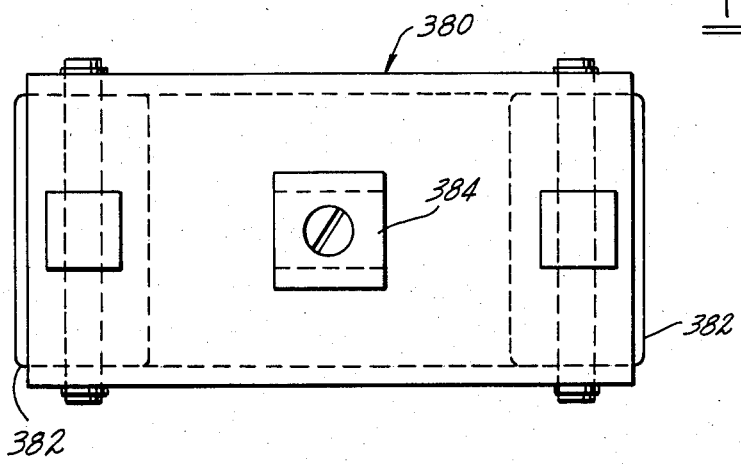
FIG. 65, a plan elevation of a roller accessory.

In FIGS. 47, 48 and 49, there are showings of the manner in which a railing can be secured to the risers at the outer edges. A railing stanchion 310 is suitably supported in a socket 160 through a conical insert 312 (See FIGS. 47 and 50.). The stanchion 310 has a plate 314 which rests on a support module 120. A bayonet slot 316, shown in FIGS. 47 and 50, is utilized in conjunction with a cross-pin 318 on a threaded shaft 317 which is resiliently biased upwardly by a coil spring 319. This pin will move the threaded shaft 317 vertically to retract it into the cone 312 for protection during shipping. When pin 318 is moved into the locking portion of the bayonet slot 316 against spring 319, the threaded end may be screwed into the lower cone 190. The railings are pivotally mounted on a top piece 320 at the joints 322 and 324 (FIG. 49) so that the railings can be aligned as in FIG. 47 or angled as in FIG. 48. If the railing stanchion is to be mounted on an angled stair rail, the structure shown in FIG. 51 is utilized where the side beam of the stair rail 330 has a socket member 332 welded thereto to receive the lower end of a rail stanchion 310.

In FIG. 52, a small two-step stair unit 340 is connected to the side rail 150 by a mechanism shown in the sectional view in FIG. 53 taken on line 53—53 of FIG. 52. The rail of the stair 340 is mounted on a bracket 342 which has fastened thereto a multi-diameter disc 344 as shown in FIGS. 54 and 55. A nut and bolt combination 346 holds the disc on the outer face of the bracket 342. This disc will slip into the re-entrant groove of the elongate extruded edge 150 of the modules and thus secure the stairs vertically so that the treads 348 can be utilized.

In FIGS. 56 and 57, a longer stair unit is shown having side angle rails 350 and 354 suitably connected together. The top of the rail 350 is connected to the edge of a support module by a mechanism illustrated in section FIG. 58. A gusset bracket 354 has a flange 356 with a turned portion 358 which overlies the metallic edge of the support module. This unit also utilizes the discs 344 described in connection with FIGS. 53 to 55, which discs slide in the re-entrant grooves of the module edge 150.

In FIGS. 59 to 61, there is illustrated a means of mounting curtains in the support modules 120. Plastic slide elements 360 can be mounted in the re-entrant grooves of the side members 150 having a Velcro surface on the outside. Thus, a curtain 362 having a Velcro strip 364 can be mounted at intervals along the side of a support module. It is also possible to shorten the curtain by folding it under and utilizing Velcro inserts 366 to fasten the curtain to shorter vertical height as shown in FIG. 61. The same Velcro strip 360 can be utilized for this purpose. FIG. 63 simply shows a curtain 370 on a supported rod 372.

Figure 67:
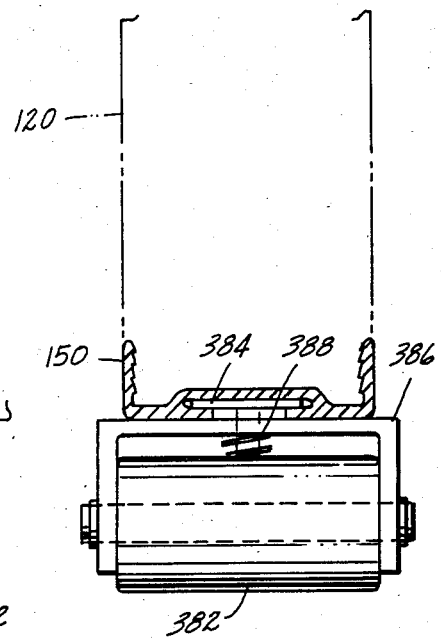
FIG. 67, an end view of the roller accessory as applied to a support module edging.
Figure 66:
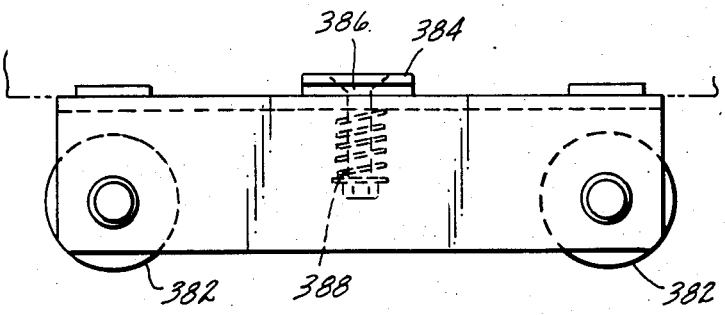
FIG. 66, a side view of the roller accessory.

In FIGS. 64 to 67, an accessory for handling the support modules 120 is illustrated. This comprises a unit 380 shown in plan view in FIG. 65. This unit has two rollers 382 at each end and has on the top surface a flanged support plate 384 supported on a bolt 386 which is biased toward the unit by a spring 388. The sides of the support plate 384 will insert into the re-entrant groove of the extruded edges of the module as shown in FIG. 67. Thus, one or two of these accessories 380 can be readily applied to the side edge of a module and the module easily rolled along a supporting surface to a place where it is ti be mounted. The units 380 can then be stripped off of the edge and re-used for other units.

We claim:

1. A staging system for construction of flat stages, choral risers and the like which comprises:

(a) a flat structural load-bearing square, rectangular or trapezoidal panel to serve as a module having spaced upper and lower surfaces, (b) an edge piece secured to one or more edges of said panel having an external re-entrant groove parallel to said panel surfaces, (c) said panel having, at each corner, recessed sockets on a common axis and opening respectively to the upper and lower surfaces of said panel, (d) railing supporting stanchions recessed into sockets opening to the top surface of a module to support railings along an edge of staging assemblies, (e) said supporting stanchions having a retractable threaded shaft at the lower end, (f) means to bias said shafts to a retracted position, and (g) means including a cross-pin and bayonet slot to lock said shafts in extended position for assembly.

2. A staging system for construction of flat stages, choral risers and the like which comprises:

(a) a flat structural load-bearing square, rectangular or trapezoidal panel to serve as a module having spaced upper and lower surfaces, (b) an edge piece secured to one or more edges of said panel having an external re-entrant groove parallel to said panel surfaces, (c) vertically spaced and overlapping module panels positioned in spaced relation to each other with each upper module panel supported at its forward edge on and in spaced relation to a lower module panel on a forward leg supported at its rearward edge by a rearward leg reaching to a support surface, (d) a lateral bar connecting said forward and rearward legs, and (e) means adjustably mechanically engaging said bar with the lower module panel to maintain a desired overlapping relationship.

3. A staging system as defined in claim 2 in which said module panels are end to end with identical module panels and said means interengages with end-to-end module panels to maintain the overlapping relationship and the end-to-end relationship of said module panels.

4. A staging system as defined in claim 2 in which said means comprises a plug in each of two aligned sockets of a module panel, and a mechanical connection between said plugs and said lateral bar.

5. A staging system for construction of flat stages, choral risers and the like which comprises:

(a) a flat structural load-bearing square, rectangular or trapezoidal panel to serve as a module having spaced upper and lower surfaces, (b) an edge piece secured to one or more edges of said panel having an external re-entrant groove parallel to said panel surfaces, and (c) means forming, at each corner of said panel, recessed sockets on a common axis opening respectively to the upper and lower surfaces of said panel, said sockets being identical but inverted relative to each other and each having facing inner ends, and outer ends adjacent the respective surfaces, and an annular groove recess in the inner surface of the socket spaced from the outer end.

6. A staging system as defined in claim 5 including:

(a) a plurality of leg elements having one or more upper ends to recess into either of said respective aligned sockets to support a module in spaced relation to a supporting surface, and (b) a spring-biased detent projecting from the upper end of each of said leg elements to engage said annular recess in a socket into which the upper end is recessed.

7. A staging system as defined in claim 6 in which said upper ends of said leg elements have a threaded axial recess open to the upper end, and plug means recessed into an aligned socket in the upper side of a panel having a threaded projection to engage said threaded axial recess to retain said leg element in recessed position.

* * * * *